US007274148B2

(12) United States Patent
Ballenger et al.

(10) Patent No.: US 7,274,148 B2
(45) **Date of Patent: *Sep. 25, 2007**

(54) LAMP HAVING FIXED FORWARD PHASE SWITCHING POWER SUPPLY WITH TIME-BASED TRIGGERING

(75) Inventors: Matthew B. Ballenger, Lexington, KY (US); Ernest C. Weyhrauch, Cookeville, TN (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/051,600

(22) Filed: Feb. 4, 2005

(65) Prior Publication Data

US 2005/0110436 A1 May 26, 2005

(51) Int. Cl.
*H01J 7/44* (2006.01)
*H05B 41/16* (2006.01)
*H05B 37/02* (2006.01)

(52) U.S. Cl. ..... 315/51; 315/72; 315/246; 315/287; 315/291; 315/360

(58) Field of Classification Search ..... 315/56, 315/72, 246, 247, 287, 291, 307, 360, 209 SC, 315/209 T, 51; 307/139, 151; 323/217
See application file for complete search history.

(56) References Cited

U.S. PATENT DOCUMENTS 3,265,930 A * 8/1966 Powell, Jr. ..... 315/209 R
3,275,922 A 9/1966 Meyer et al. ..... 321/15
3,450,891 A * 6/1969 Riley ..... 361/6
3,491,284 A * 1/1970 Pascente ..... 323/319
3,594,591 A * 7/1971 Laupman ..... 327/457
3,609,402 A * 9/1971 Ferro et al. ..... 327/190
3,742,337 A * 6/1973 Digneffe ..... 323/300
3,746,970 A * 7/1973 Van Cleave ..... 323/238
3,763,395 A * 10/1973 Shilling et al. ..... 315/307
3,869,631 A 3/1975 Anderson et al. ..... 313/217
3,886,405 A * 5/1975 Kubo ..... 315/246
3,906,302 A * 9/1975 Wijsboom ..... 315/209 R
4,032,817 A * 6/1977 Richmond ..... 315/149
4,224,563 A * 9/1980 Hardy ..... 315/308
4,230,970 A * 10/1980 Potter et al. ..... 315/307
4,308,494 A * 12/1981 Gelfand et al. ..... 323/242
4,435,677 A * 3/1984 Thomas ..... 323/235
4,480,211 A 10/1984 Eggers ..... 315/70
4,500,813 A 2/1985 Weedall ..... 315/276
4,501,994 A * 2/1985 Spreadbury ..... 315/307
4,540,265 A * 9/1985 Harvey ..... 396/163
4,893,063 A 1/1990 Pernyeszi ..... 315/307
4,904,903 A * 2/1990 Pacholok ..... 315/209 R
4,922,155 A 5/1990 Morris et al. ..... 315/205
4,935,691 A * 6/1990 Lamar ..... 323/323

(Continued)

*Primary Examiner*—Thuy Vinh Tran
(74) *Attorney, Agent, or Firm*—Carlo S. Bessone

(57) ABSTRACT

A lamp contains a lamp voltage conversion circuit that is entirely within a base for converting a line voltage at a lamp terminal to an RMS load voltage at a light emitting element. The voltage conversion circuit includes a forward clipping circuit with a three-terminal thyristor that forward clips a load voltage to define the RMS load voltage, and a time-based pulse source that provides pulses the trigger conduction of the three-terminal thyristor at constant time intervals that are independent of the magnitude of the line voltage.

5 Claims, 7 Drawing Sheets

U.S. PATENT DOCUMENTS 4,988,921 A * 1/1991 Ratner et al. ..... 315/159
5,387,849 A * 2/1995 Sridharan ..... 315/247
5,576,614 A * 11/1996 Meads et al. ..... 323/239
5,585,697 A * 12/1996 Cote et al. ..... 315/157
5,596,247 A * 1/1997 Martich et al. ..... 315/56
5,859,506 A 1/1999 Lemke ..... 315/308
5,892,391 A * 4/1999 Hughes ..... 327/438
6,208,090 B1 3/2001 Skilskyj et al. ..... 315/360
6,445,133 B1 9/2002 Lin et al. ..... 315/57

* cited by examiner

LAMP HAVING FIXED FORWARD PHASE SWITCHING POWER SUPPLY WITH TIME-BASED TRIGGERING

BACKGROUND OF THE INVENTION

The present invention is directed to a power controller that supplies a specified power to a load, and more particularly to a voltage converter for a lamp that converts line voltage to a voltage suitable for lamp operation.

Some loads, such as lamps, operate at a voltage lower than a line (or mains) voltage of, for example, 120V or 220V, and for such loads a voltage converter that converts line voltage to a lower operating voltage must be provided. The power supplied to the load may be controlled with a phase-control clipping circuit that includes an RC circuit. Some of these loads operate most efficiently when the power is constant (or substantially so). However, line voltage variations are magnified by the RC circuit phase-control circuits due to their inherent properties (as will be explained below). A (more nearly) constant RMS load voltage from the phase-control circuit is desirable.

A simple four-component RC phase-control clipping circuit demonstrates a problem of conventional phase-control clipping circuits. The phase-controlled clipping circuit shown in FIG. 1 has a capacitor 22, a diac 24, a triac 26 that is triggered by the diac 24, and resistor 28. The resistor 28 may be a potentiometer that sets a resistance in the circuit to control a phase at which the triac 26 fires.

In operation, a clipping circuit such as shown in FIG. 1 has two states. In the first state the diac 24 and triac 26 operate in the cutoff region where virtually no current flows. Since the diac and triac function as open circuits in this state, the result is an RC series network such as illustrated in FIG. 2. Due to the nature of such an RC series network, the voltage across the capacitor 22 leads the line voltage by a phase angle that is determined by the resistance and capacitance in the RC series network. The magnitude of the capacitor voltage $V_C$ is also dependent on these values.

The voltage across the diac 24 is analogous to the voltage drop across the capacitor 22 and thus the diac will fire once breakover voltage $V_{BO}$ is achieved across the capacitor. The triac 26 fires when the diac 24 fires. Once the diac has triggered the triac, the triac will continue to operate in saturation until the diac voltage approaches zero. That is, the triac will continue to conduct until the line voltage nears zero crossing. The virtual short circuit provided by the triac becomes the second state of the clipping circuit as illustrated in FIG. 3.

Triggering of the triac 26 in the clipping circuit is forward phase-controlled by the RC series network and the leading portion of the line voltage waveform is clipped until triggering occurs as illustrated in FIGS. 4-5. A load attached to the clipping circuit experiences this clipping in both voltage and current due to the relatively large resistance in the clipping circuit.

Accordingly, the RMS load voltage and current are determined by the resistance and capacitance values in the clipping circuit since the phase at which the clipping occurs is determined by the RC series network and since the RMS voltage and current depend on how much energy is removed by the clipping.

With reference to FIG. 6, clipping is characterized by a conduction angle $\alpha$ and a delay angle $\theta$. The conduction angle is the phase between the point on the load voltage/current waveforms where the triac begins conducting and the point on the load voltage/current waveform where the triac stops conducting. Conversely, the delay angle is the phase delay between the leading line voltage zero crossing and the point where the triac begins conducting.

Define $V_{irrms}$ as RMS line voltage, $V_{orms}$ as RMS load voltage, T as period, and $\omega$ as angular frequency (rad) with $\omega=2\pi f$.

Line voltage may vary from location to location up to about 10% and this variation can cause a harmful variation in RMS load voltage in the load (e.g., a lamp). For example, if line voltage were above the standard for which the voltage conversion circuit was designed, the triac 26 may trigger early thereby increasing RMS load voltage. In a halogen incandescent lamp, it is particularly desirable to have an RMS load voltage that is nearly constant.

Changes in the line voltage are exaggerated at the load due to a variable conduction angle, and conduction angle is dependent on the rate at which the capacitor voltage reaches the breakover voltage of the diac. For fixed values of frequency, resistance and capacitance, the capacitor voltage phase angle ($\theta_C$) is a constant defined by $\theta_C=\arctan(-\omega RC)$. Therefore, the phase of $V_C$ is independent of the line voltage magnitude. However, the rate at which $V_C$ reaches $V_{BO}$ is a function of $V_{irrms}$ and is not independent of the line voltage magnitude.

FIG. 7 depicts two possible sets of line voltage $V_i$ and capacitor voltage $V_C$. As may be seen therein, the rate at which $V_C$ reaches $V_{BO}$ varies depending on $V_{irrms}$. For RC phase-control clipping circuits the point at which $V_C=V_{BO}$ is of concern because this is the point at which diac/triac triggering occurs. As $V_{irrms}$ increases, $V_C$ reaches $V_{BO}$ earlier in the cycle leading to an increase in conduction angle ($\alpha_2>\alpha_1$), and as $V_{irrms}$ decreases, $V_C$ reaches $V_{BO}$ later in the cycle leading to a decrease in conduction angle ($\alpha_2<\alpha_1$).

Changes in $V_{irrms}$ leading to exaggerated or disproportional changes in $V_{orrms}$ are a direct result of the relationship between conduction angle and line voltage magnitude. As $V_{irrms}$ increases, $V_{orrms}$ increases due to both the increase in peak voltage and the increase in conduction angle, and as $V_{irrms}$ decreases, $V_{orrms}$ decreases due to both the decrease in peak voltage and the decrease in conduction angle. Thus, load voltage is influenced twice, once by a change in peak voltage and once by a change in conduction angle, resulting in unstable RMS load voltage conversion for the simple phase-control clipping circuit.

It is known to use a thyristor where a variable power is applied to a load, such as a lamp. The amount of power provided to the load during each cycle depends on the timing of the current pulses applied to the gate of the thyristor. More power is delivered to the load when the pulses are applied near the beginning of a cycle and less power is delivered when the pulses are applied later in the cycle. However, the use of a thyristor does not solve the problem of the RC phase-control circuits because the timing of the pulses to the thyristor is not independent of variations in the magnitude of the line voltage.

When a voltage converter is used in a lamp, the voltage converter may be provided in a fixture to which the lamp is connected or within the lamp itself. U.S. Pat. No. 3,869,631 is an example of the latter, in which a diode is provided in an extended stem between the lamp screw base and stem press of the lamp for clipping the line voltage to reduce RMS load voltage at the light emitting element. U.S. Pat. No. 6,445,133 is another example of the latter, in which a voltage conversion circuit for reducing the load voltage at the light emitting element is divided with a high temperature-tolerant part in the lamp base and a high temperature-intolerant part in a lower temperature part of the lamp spaced from the high temperature-tolerant part.

SUMMARY OF THE INVENTION

An object of the present invention is to provide a novel phase-control power controller that converts a line voltage to an RMS load voltage independently of variations in line voltage magnitude.

A further object is to provide a novel phase-control power controller with a fixed forward phase-control clipping circuit that forward clips a load voltage to provide an RMS load voltage, where a conduction angle of the phase-control clipping circuit is defined by a time-based pulse source that provides pulses at constant time intervals to trigger conduction in a three-terminal thyristor in the phase-control clipping circuit independently of variations in line voltage magnitude.

A still further object is to provide a novel lamp having this power controller in a voltage conversion circuit that converts a line voltage at a lamp terminal to the RMS load voltage usable by a light emitting element of the lamp.

DESCRIPTION OF PREFERRED EMBODIMENTS

Figure 1:
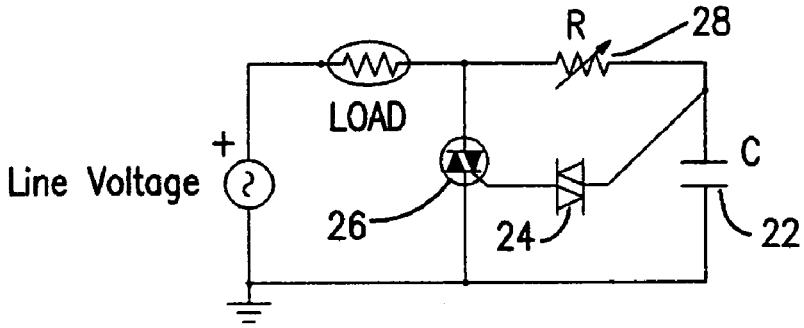
FIG. 1 PRIOR ART
FIG. 1 is a schematic circuit diagram of a phase-controlled clipping circuit of the prior art.
Figure 2:
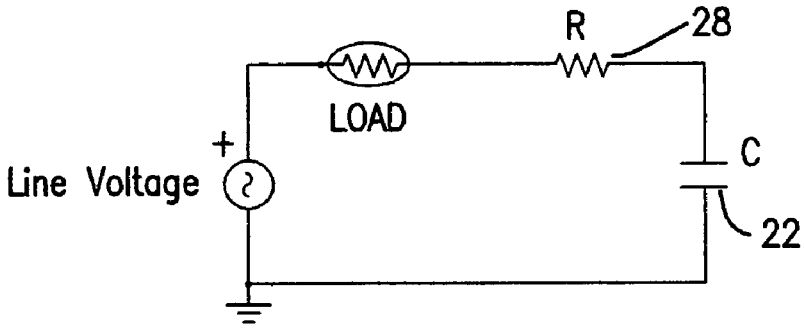
FIG. 2 PRIOR ART
FIG. 2 is a schematic circuit diagram of the phase-controlled dimming circuit of FIG. 1 showing an effective state in which the triac is not yet triggered.
Figure 3:
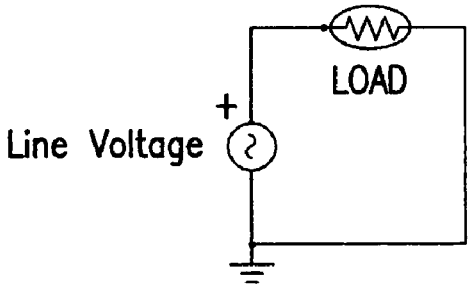
FIG. 3 PRIOR ART
FIG. 3 is a schematic circuit diagram of the phase-controlled dimming circuit of FIG. 1 showing an effective state in which the triac has been triggered.
Figure 4:
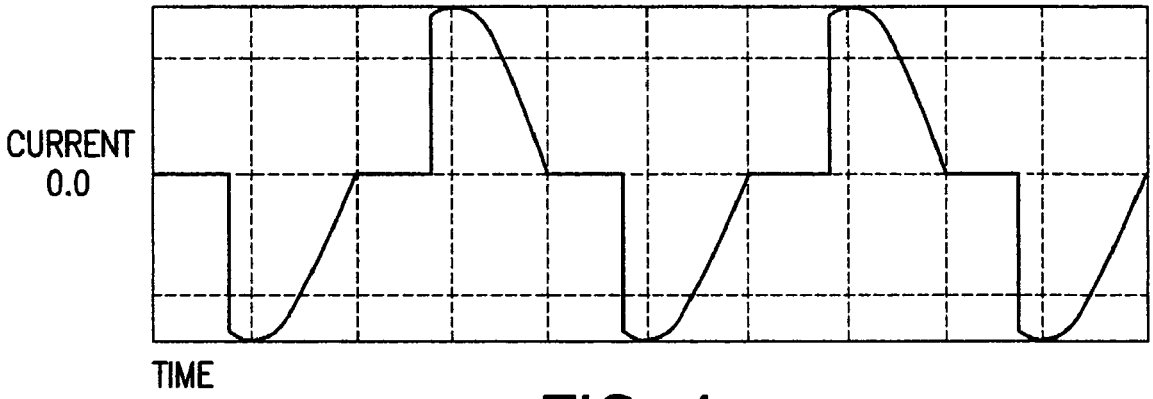
FIG. 4 PRIOR ART
FIG. 4 is a graph illustrating forward clipping of the current in the phase-controlled dimming circuit of FIG. 1.
Figure 5:
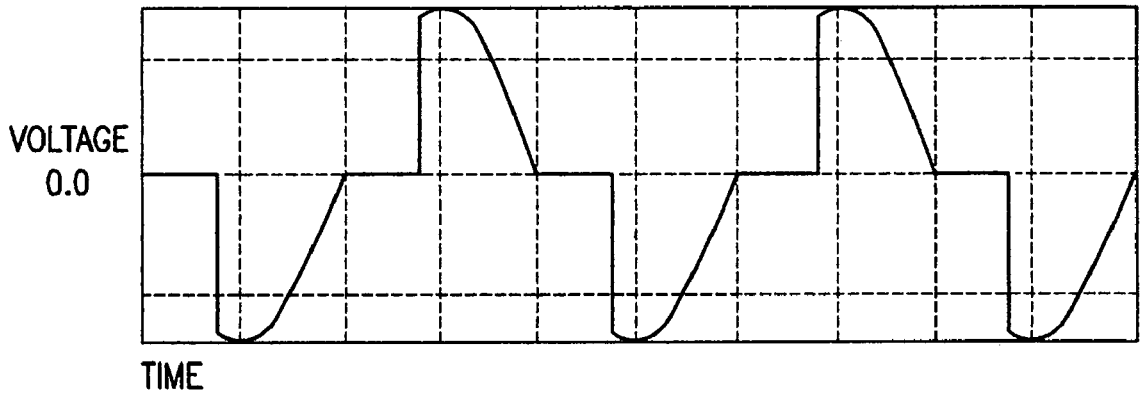
FIG. 5 PRIOR ART
FIG. 5 is a graph illustrating forward clipping of the voltage in the phase-controlled dimming circuit of FIG. 1.
Figure 6:
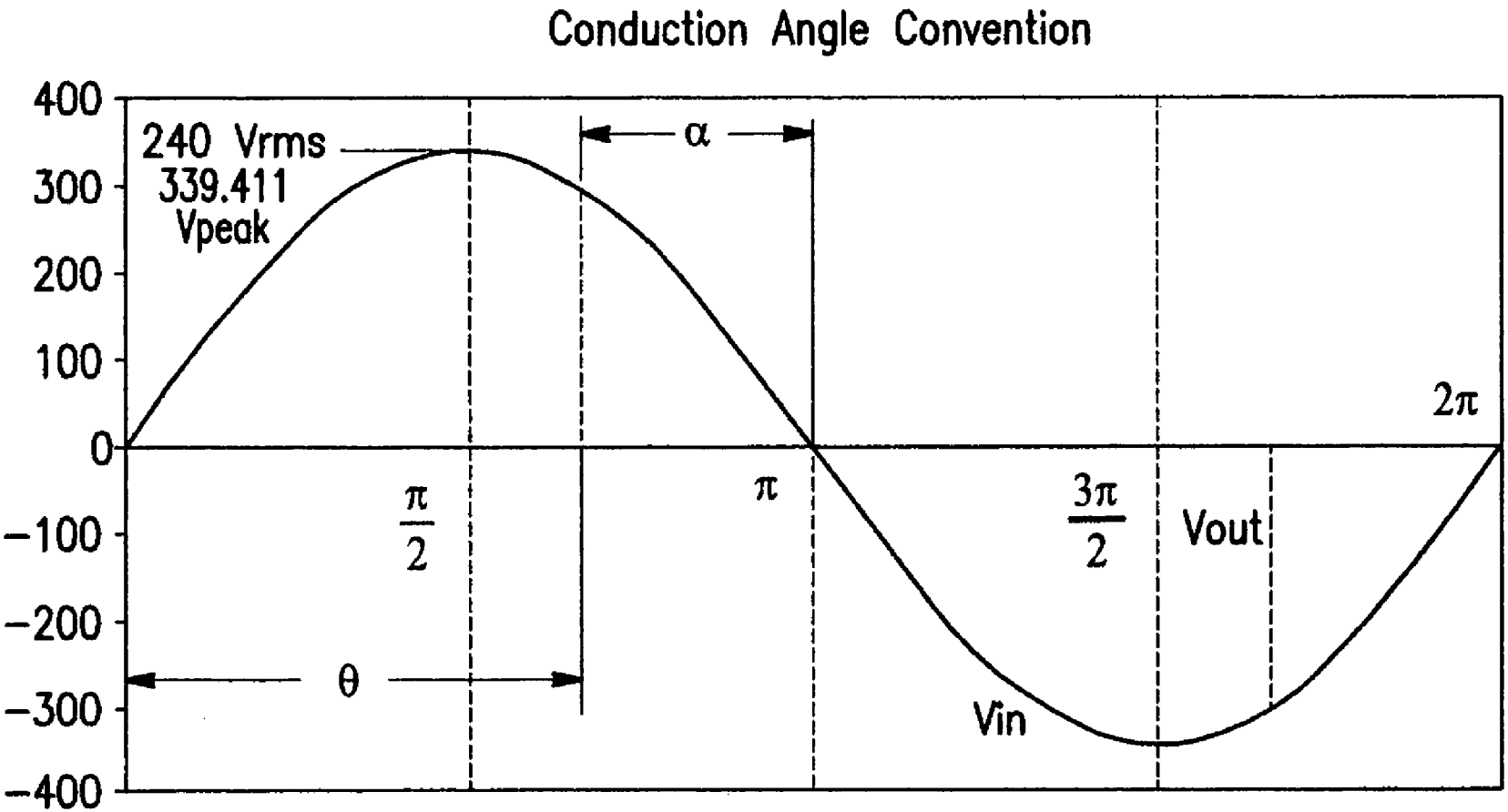
FIG. 6 PRIOR ART
FIG. 6 is a graph showing the convention for definition of the conduction angle $\alpha$.
Figure 7:
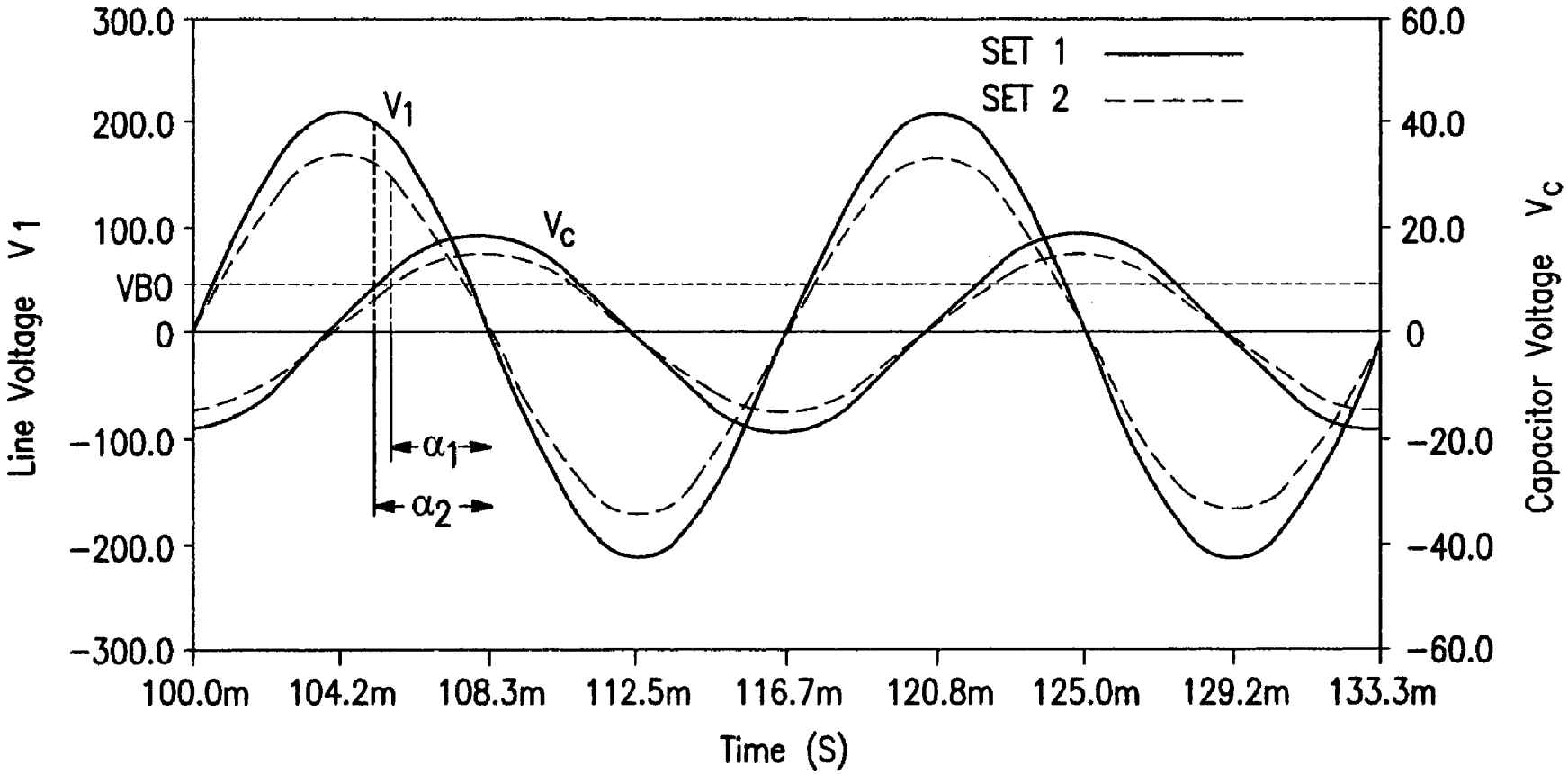
FIG. 7 PRIOR ART
FIG. 7 is a graph showing how changes in the magnitude of the line voltage affect the rate at which capacitor voltage reaches the diac breakover voltage.
Figure 8:
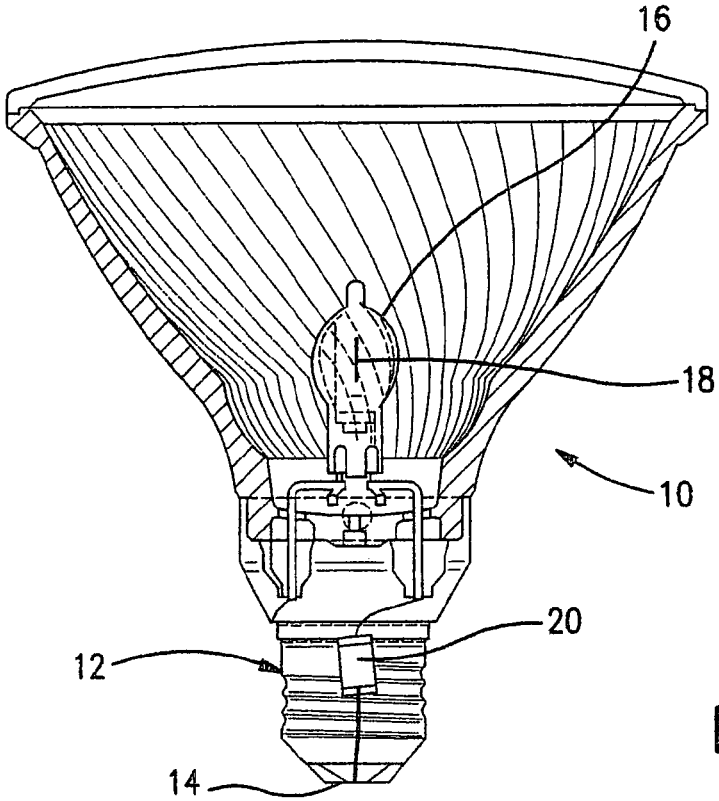
FIG. 8 is a partial cross section of an embodiment of a lamp of the present invention.

With reference to FIG. 8, a lamp 10 includes a base 12 with a lamp terminal 14 that is adapted to be connected to line (mains) voltage, a light-transmitting envelope 16 attached to the base 12 and housing a light emitting element 18 (an incandescent filament in the embodiment of FIG. 8), and a voltage conversion circuit 20 for converting a line voltage at the lamp terminal 14 to a lower operating voltage. The voltage conversion circuit 20 may be entirely within the base 12 and connected between the lamp terminal 14 and the light emitting element 18. The voltage conversion circuit 20 may be an integrated circuit in a suitable package as shown schematically in FIG. 1.

While FIG. 8 shows the voltage conversion circuit 20 in a parabolic aluminized reflector (PAR) halogen lamp, the voltage conversion circuit 20 may be used in any incandescent lamp when placed in series between the light emitting element (e.g., filament) and a connection (e.g., lamp terminal) to a line voltage. Further, the voltage conversion circuit described and claimed herein finds application other than in lamps and is not limited to lamps.

Figure 9:
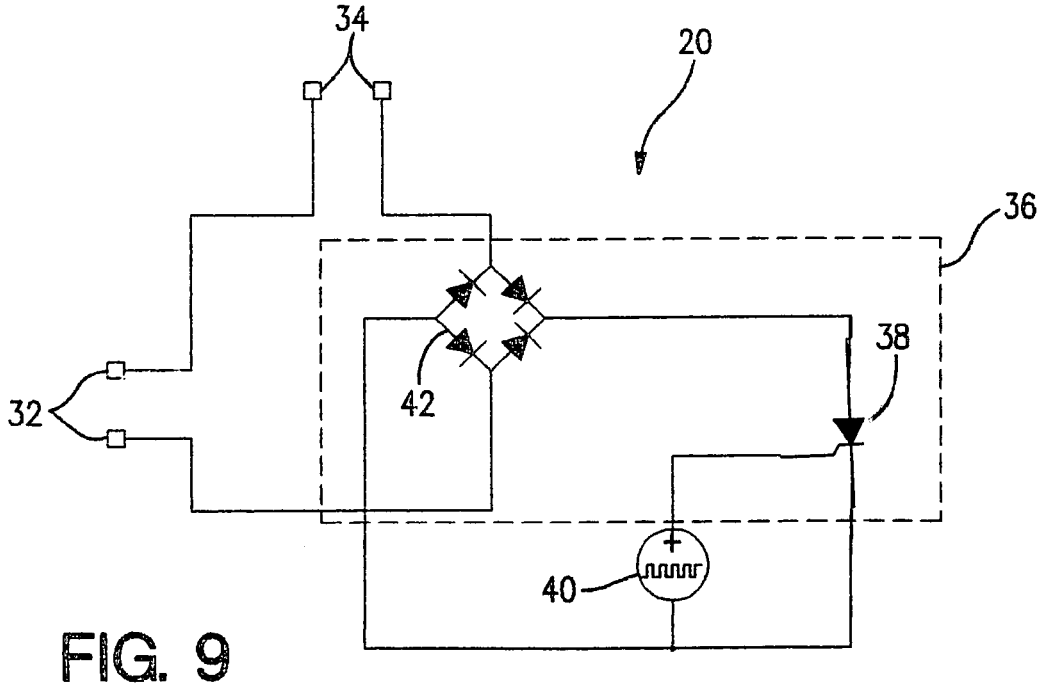
FIG. 9 is a schematic circuit diagram showing an embodiment of the fixed, forward phase-control power controller of the present invention.

With reference to FIG. 9 that illustrates an embodiment of the present invention, the voltage conversion circuit 20 includes line terminals 32 for a line voltage and load terminals 34 for a load voltage, a phase-control clipping circuit 36 that clips the load voltage and that is connected to the line and load terminals and has a three-terminal thyristor 38 (in this embodiment, a semiconductor controlled rectifier—SCR) wherein a conduction angle of the phase-control clipping circuit 36 determines an RMS load voltage, and a time-based signal source 40 that sends signals at constant time intervals to a gate of the three-terminal thyristor 38 that cause the three-terminal thyristor to be ON during time periods that define the conduction angle for the phase-control clipping circuit 36. In this embodiment that uses an SCR, a full wave bridge 42 is also provided and the signals from the time-based signal source 40 have a positive polarity.

Figure 10:
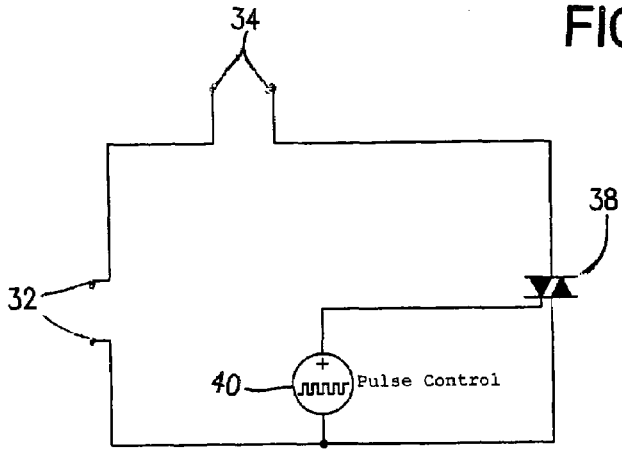
FIG. 10 is a schematic circuit diagram showing a further embodiment of the fixed, forward phase-control power controller of the present invention.

In another embodiment shown in FIG. 10, the three-terminal thyristor 38 is a triac. Since the triac is bidirectional (the SCR shown in FIG. 9 is not), the circuit arrangement may be changed by not including the bridge and by using signals of either polarity from the time-based signal source 40. A similar effect is achieved by using a pair of SCRs and control signals of opposite polarity.

Figure 11:
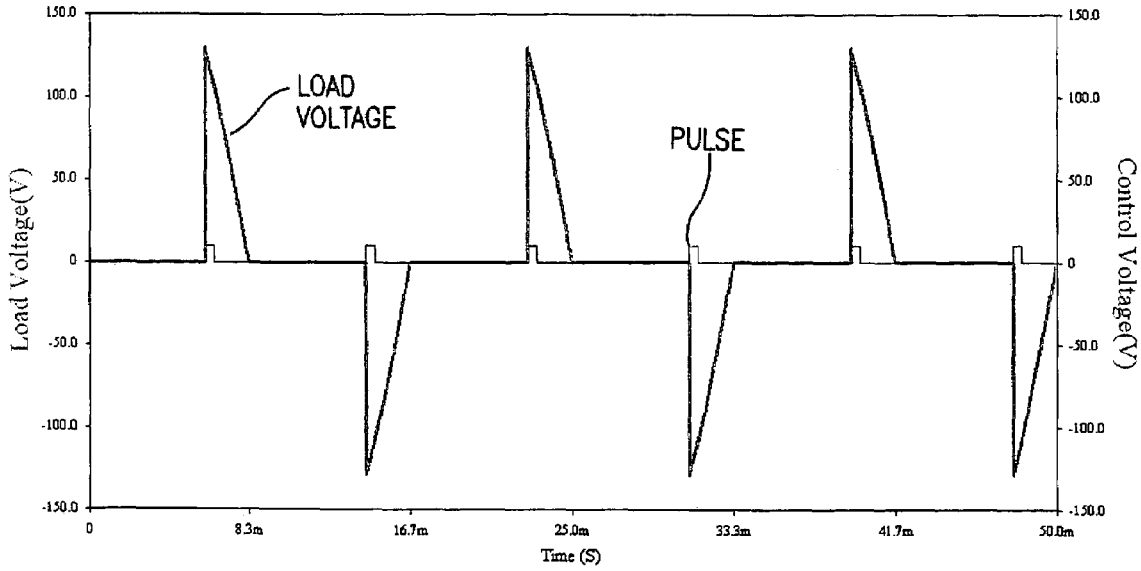
FIG. 11 is a graph depicting the phase clipping of the present invention, including the clipped load voltage and the pulse signal from the time-based signal source.

The time-based signal source 40 operates independently of line voltage and thus is independent of variations in the line voltage. The time-based signal source 40 may be a suitable microcontroller, timer (such as a conventional "555" timer), or pulse generator that provides pulses of suitable polarity at constant time intervals. The timing of the pulses is set to clip the load voltage at the appropriate place in the voltage waveform to provide the desired RMS voltage. Since the frequency of the voltage waveform does not change (even though its magnitude might vary), the timing of the pulses are set in the circuit for a particular frequency where the lamp is to be used (e.g., 50 or 60 Hz). FIG. 11 shows the pulses and the resulting clipped load voltage. Note that the pulses initiate the clipping but are not sustained during the entire conduction angle since the three-terminal thyristor remains ON following the pulse. The pulses need only have a duration sufficient to initiate conduction in the thyristor.

In other words, the voltage conversion circuit includes a fixed, forward phase-control clipping circuit that forward clips a load voltage and provides an RMS load voltage to the lamp, where the phase-control clipping circuit has a time-based signal source that triggers conduction of the three-terminal thyristor at constant time intervals independently of variations in line voltage magnitude.

Conventional RC phase-control clipping circuits are very sensitive to fluctuations in the line voltage magnitude. The present invention provides a power controller that operates substantially independently of the line voltage magnitude by incorporating time-based pulses to trigger conduction and thereby reduce the variation of the conduction angle compared to conventional RC phase-control circuits.

Figure 12:
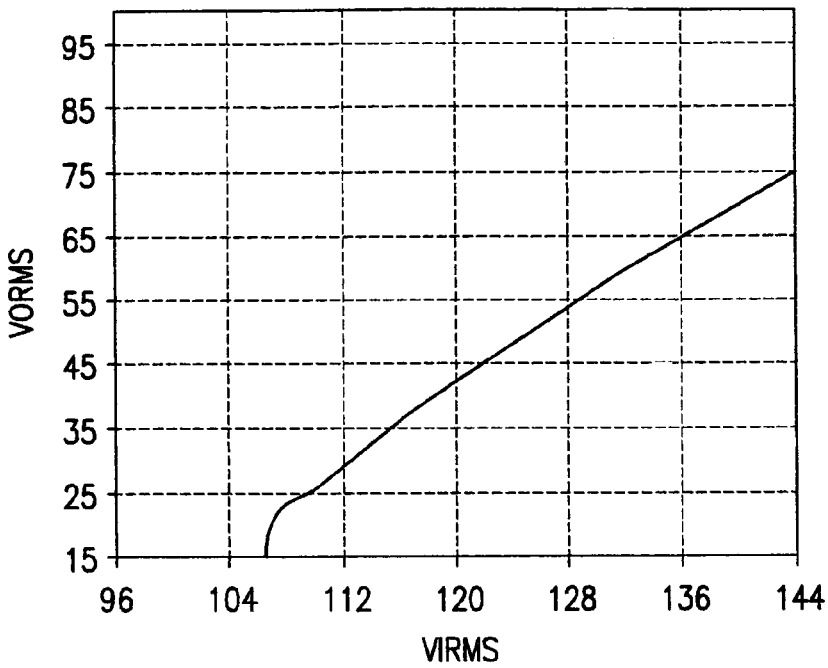
FIG. 12 PRIOR ART
FIG. 12 is a graph of $V_{orms}$ versus $V_{irms}$ for a conventional RC phase-control power controller designed to produce 42 $V_{rms}$ output for 120 $V_{rms}$ input.
Figure 13:
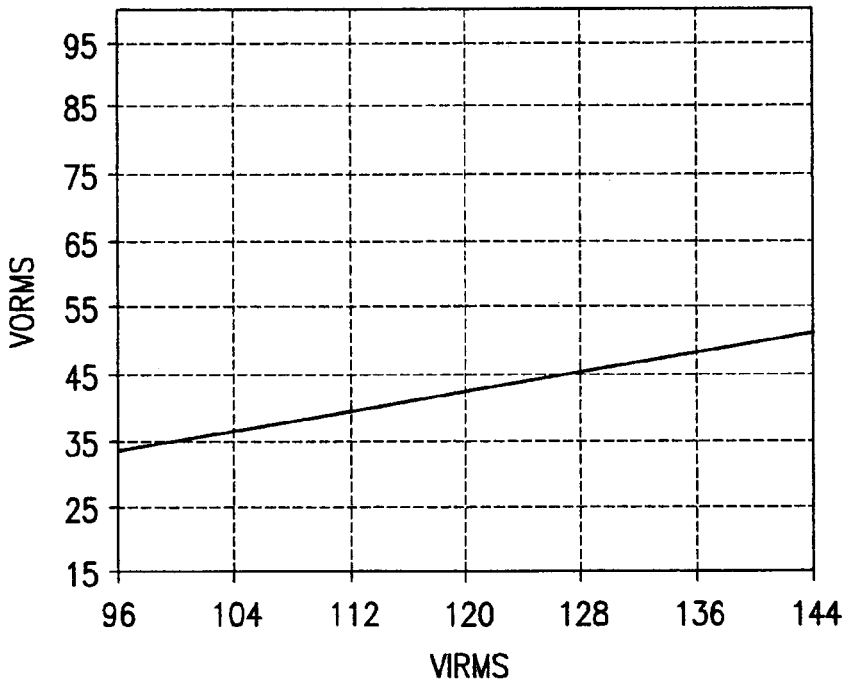
FIG. 13 is a graph of $V_{orms}$ versus $V_{irms}$ for a fixed phase-control power controller incorporating the present invention and designed to produce 42 $V_{rms}$ output for 120 $V_{rms}$ input.

FIGS. 12 and 13 illustrate the improvement afforded by the present invention. FIG. 12 shows relationship between $V_{orms}$ and $V_{irms}$ in a prior art RC phase-control clipping circuit, while FIG. 13 shows the relationship for the fixed, reverse phase-control clipping circuit of the present invention. In each instance the circuit is designed to produce 42 $V_{rms}$ output for a 120 $V_{rms}$ input. Note that the output voltage varies considerably more in FIG. 12 than in FIG. 13.

The description above refers to use of the present invention in a lamp. The invention is not limited to lamp applications, and may be used more generally where resistive or inductive loads (e.g., motor control) are present to convert an unregulated AC line or mains voltage at a particular frequency or in a particular frequency range to a regulated RMS load voltage of specified value.

While embodiments of the present invention have been described in the foregoing specification and drawings, it is to be understood that the present invention is defined by the following claims when read in light of the specification and drawings.

What is claimed is:

1. A lamp comprising:

a base having a lamp terminal;

a light emitting element attached to said base;

a lamp voltage conversion circuit that is entirely within said base and connected between said lamp terminal and said light emitting element, said voltage conversion circuit converting a line voltage at said lamp terminal to an RMS load voltage at said light emitting element; and said voltage conversion circuit including a forward clipping circuit with a three-terminal thyristor that forward clips a load voltage to define the RMS load voltage, and a time-based pulse source that provides pulses that trigger conduction of said three-terminal thyristor at constant time intervals of one pulse for each half cycle of said line voltage that are independent of a magnitude of the line voltage.

2. The lamp of claim 1, wherein said voltage conversion circuit is an integrated circuit.

3. The lamp of claim 1, wherein said three-terminal thyristor is an SCR and said pulses have a positive polarity.

4. The lamp of claim 1, wherein said three-terminal thyristor is a triac.

5. The lamp of claim 1, wherein said time-based signal source is one of a pulse generator, a microcontroller and a timer.

* * * * *